United States Patent [19]

Hemmat

[11] Patent Number: 4,960,245

[45] Date of Patent: Oct. 2, 1990

[54] CASTING NOZZLE WITH DISCHARGE SLOT DEFINED BY REFRACTORY INSERTS

[75] Inventor: Naim S. Hemmat, Mendham, N.J.

[73] Assignee: Electric Power Research Institute, Palo Alto, Calif.

[21] Appl. No.: 346,953

[22] Filed: May 3, 1989

Related U.S. Application Data

[63] Continuation of Ser. No. 458,765, Jan. 17, 1983, Pat. No. 4,843,692.

[51] Int. Cl.[5] ..... B05B 1/00; B22D 41/08

[52] U.S. Cl. ..... 239/597; 29/157 C; 222/591

[58] Field of Search ..... 239/455, 591, 597, 589; 222/591, 594, 599; 156/293, 303.1; 29/157 C; 164/423, 463

[56] References Cited

U.S. PATENT DOCUMENTS

| | | | |
|---|---|---|---|
| 2,128,941 | 9/1938 | Hudson | 222/591 |
| 3,633,654 | 1/1972 | Auman et al. | 222/594 |
| 3,797,712 | 3/1974 | Kutzer et al. | 222/591 |
| 3,810,583 | 5/1974 | George | 239/597 |
| 4,212,343 | 7/1980 | Narasimhan | 164/423 |
| 4,453,654 | 6/1984 | Bedell | 164/423 |
| 4,709,743 | 12/1987 | Law et al. | 222/599 |

*Primary Examiner*—Andres Kashnikow
*Assistant Examiner*—Christopher G. Trainor
*Attorney, Agent, or Firm*—King & Schickli

[57] ABSTRACT

A continuous casting nozzle for controllably casting an elongated ribbon has a discharge slot extending completely across an exterior surface of the nozzle in fluid communication with an internally disposed through flow passage. Refractory insert material compatible with the nozzle material, such as refractory cement, is filled into the longitudinal ends of the discharge slot to define the width of a centrally disposed discharge slot for the nozzle. The continuous groove with insert material allows for economy and flexibility in the nozzle manufacturing process and results in a nozzle having an adjustable discharge slot width less susceptible to stress cracks.

4 Claims, 2 Drawing Sheets

CASTING NOZZLE WITH DISCHARGE SLOT DEFINED BY REFRACTORY INSERTS

This is a continuation of application Ser. No. 458,765, filed Jan. 17, 1983, now U.S. Pat. No. 4,843,692.

TECHNICAL FIELD

The invention relates to casting nozzles of the type used in casting continuous metal strips or ribbons by controllably depositing molten metal through an elongated dispensing slot of the nozzle onto a moving chilled substrate. The invention will be specifically disclosed in connection with a casting nozzle with a structurally stable, variable length dispensinq slot. More particularly, the discharge path for the molten metal through the elongated slot is defined by refractory insert material disposed in the end portions of the slot.

BACKGROUND OF THE INVENTION

In the process of continuously casting metal strips, such as ribbons, it is common practice to dispense molten metal through an elongated slot of a dispensing nozzle onto a relatively moving chilled surface positioned immediately adjacent the elongated slot. The molten metal solidifies soon after contact with the chilled surface. A relatively thin elongated strip or ribbon having an amorphous molecular structure cast in this manner has proven to be effective for winding into highly efficient cores for electrical transformers, and other uses. Recent developments in the casting of amorphous metal strips are reviewed in U.S. Pat. No. 4,142,571.

A conventional nozzle for depositing molten metal ribbons in a continuous casting operation has a body formed of ceramic material. The nozzle body has a relatively large opening on one side for receiving molten metal from a crucible. This relatively large opening extends into a hollow interior melt chamber in the nozzle, which melt chamber converges into a relatively narrow elongated dispensing slot.

Considerable difficulties have been experienced in the past in providing elongated dispensing slots of consistent dimension. Moreover, due to the fact that the nozzles are frequently formed of ceramic material, the dispensing slots have been formed by relatively expensive methods, such as diamond wheel cutting, laser cutting or ultrasonic cutting. Many of these techniques have resulted in irregular surfaces on the longitudinal ends of the slots. Consequently, it is commonly necessary to manually file and square off the longitudinal ends of the dispensing slots.

Further, the width of cast ribbons dispensed through such nozzles is generally a function of the longitudinal dimension of the slot in the nozzle. In the past, it was necessary to determine the slot width at the cutting state, each desired ribbon width being formed by a slot of corresponding slot length. Thus, once the slot was cut, the nozzle became dedicated for producing a single ribbon width.

The ends of the longitudinal dispensing slots in prior art nozzles have also been subject to stress concentrations. Cracks tend to originate in these areas of stress concentration and propagate throughout the nozzle, resulting in nozzle failure. Hence, a substantial need existed for reducing both the formation and propagation of stress cracks.

It has also been known to provide relatively expensive casting surfaces having lateral dams to confine and limit the width of the cast ribbon. In U.S. Pat. No. 3,228,072, for example, a plurality of small blocks of hard, heat resistant metal are strung in end to end relationship on lateral sides of a continuously moving casting surface of an endless belt. The laterally disposed dams are adjustable to produce cast strips of different widths.

In U.S. Pat. No. 1,600,688, the thickness of a cast metal sheet is determined by a gasket or plate. This last mentioned patent teaches that the plate for guaging the thickness of the cast sheet may either extend beyond the ends of the casting slot or close portions of that slot to alter the shape of the cast metal.

SUMMARY OF THE INVENTION

Accordingly, it is a primary object of the present invention to provide a casting nozzle with a readily alterable discharge slot.

It is a further object of the invention to provide an inexpensively manufactured nozzle for casting continuous metal strips.

It is yet another object of the present invention to provide a structurally stable casting nozzle which reduces stress concentrations, limiting both the formation and propagation of stress cracks and increasing nozzle life.

It is a further object of the present invention to provide a nozzle with a dispensing slot of consistent dimension.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, the invention advances the teachings of the prior art by providing an inexpensively machined dispensing slot which may be readily varied to produce ribbons of a desired width. A melt resevoir in the nozzle leads to an external groove which extends across the entire length of the nozzle. Various discharge slot lengths are produced by filling in the elongated slot from the two ends with a fill material, such as refractory cement. The invention also reduces both crack formation and propagation and allows for the use of a nonsymetrical fill-in wherein the discharge slot could be positioned so as to interface with a casting surface at a desired lateral location.

According to the method of the invention, a continuous casting nozzle with a through passageway is formed. A discharge slot is then machined on the external surface of the nozzle in fluid communication with the through passageway. Insert material is then filled in the end portions of the slot in any desired manner to define a desired discharge path for molten metal cast through the nozzle.

Still other objects of the invention will become apparent to those skilled in the art from the following description. There is shown and described a preferred embodiment of the invention, simply by way of illustration of one of the best modes contemplated for carrying out the invention. As will be realized, the invention is capable of still other embodiments, and its several details are capable of modification in various, obvious respects all without departing from the invention. Accordingly, the drawings and description that follow will be regarded as illustrative in nature and not restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example which is illustrated in the accompanying drawings.

BEST MODE OF CARRYING OUT THE INVENTION

Figure 1:
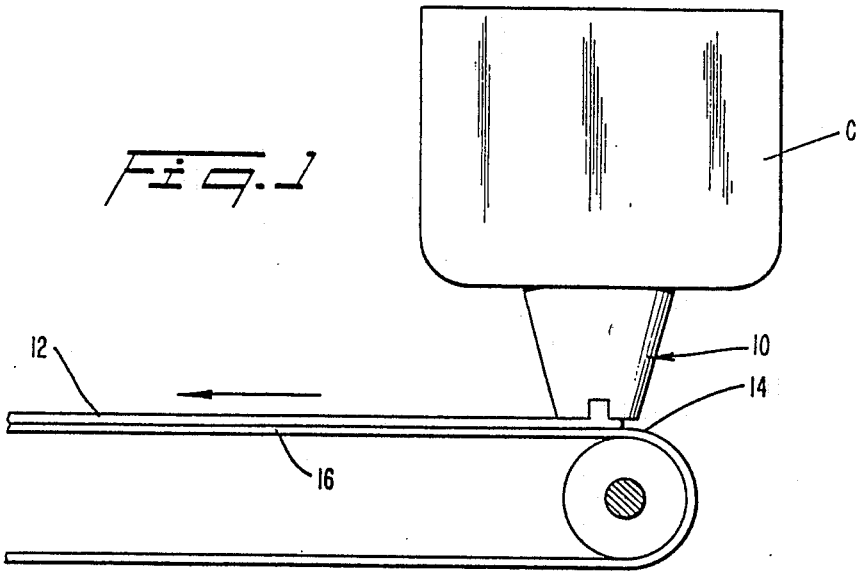
FIG. 1 is a schematic side elevational view of a dispensing nozzle according to the present invention depositing a continuous metal ribbon onto a relatively moving substrate casting surface.

Reference is first made to FIG. 1 which schematically depicts a ceramic nozzle 10 casting a relatively thin elongated strip of amorphous metal 12 onto the casting surface 14 of a continuously rotating endless belt 16. The nozzle 10 is suitably secured to a crucible C of a casting assembly. The crucible C is in fluid communication with the nozzle 10 and serves as a reservoir for molten metal to be cast through the nozzle 10.

Figure 2A:
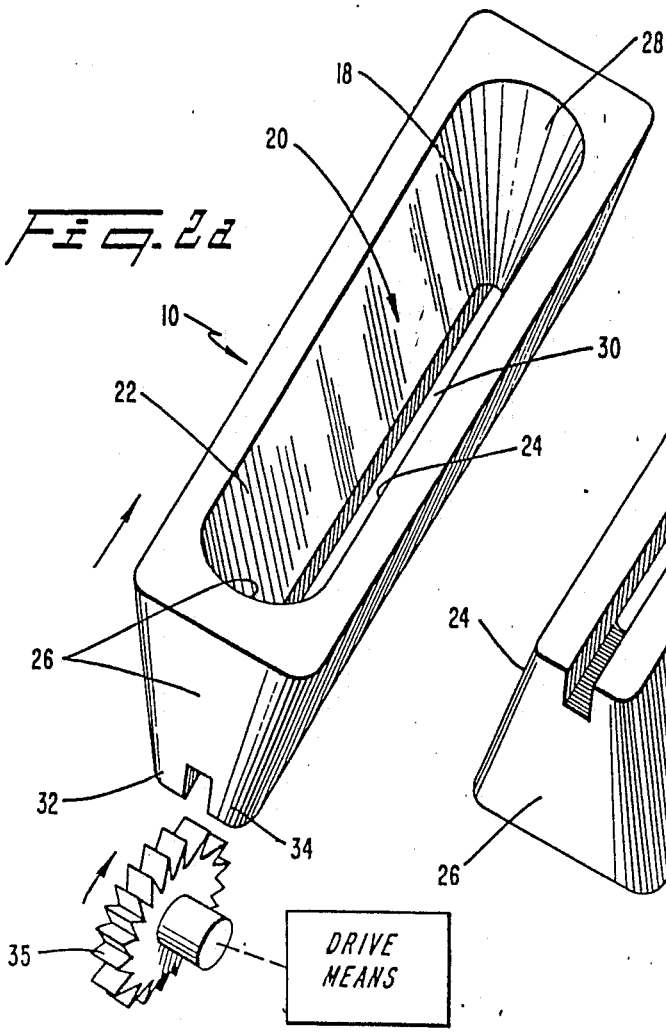
FIG. 2*a* is a perspective view of the inlet side of the nozzle of FIG. 1 depicting an interior passageway through the nozzle.
Figure 2B:
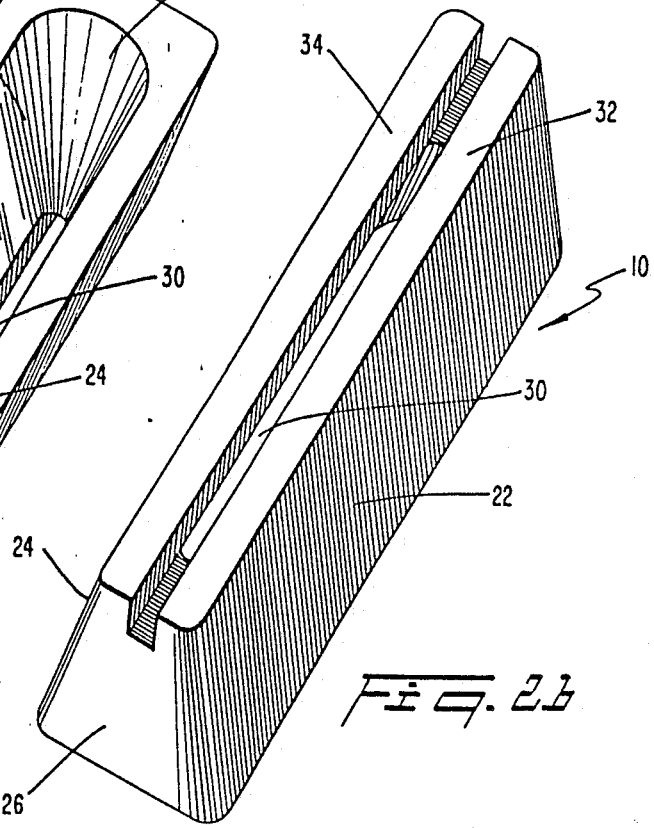
FIG. 2*b* is a perspective view of the outlet side of the nozzle of FIGS. 1 and 2*a* showing a machined groove extending completely across the nozzle.
Figure 3A:
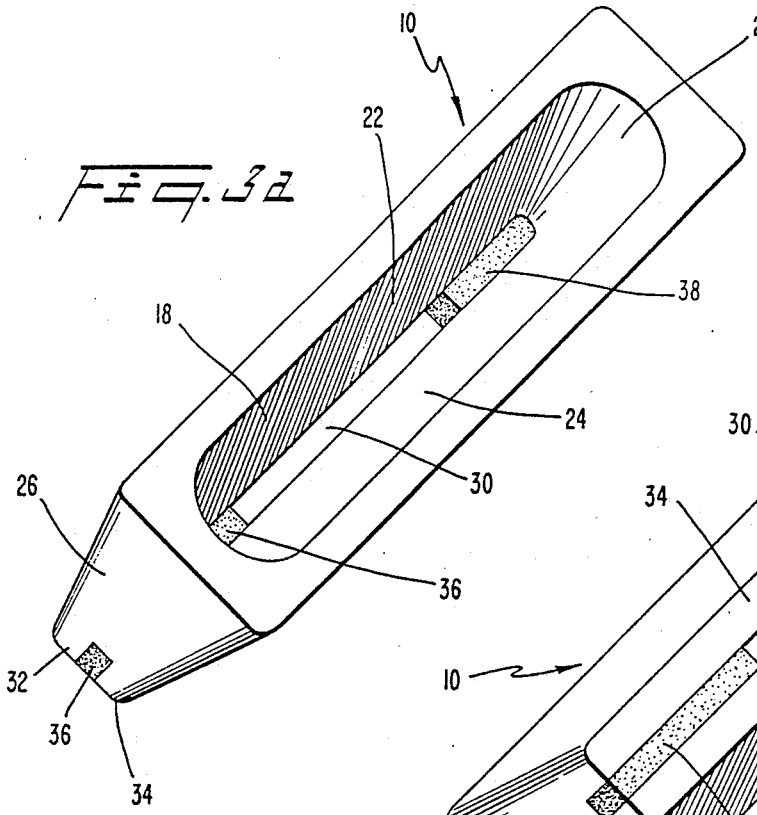
FIG. 3*a* is a perspective view of the inlet side of the nozzle of FIG. 1 depicting a continuously machined discharge slot with refractory cement in the end portions of the slot to limit the discharge path out of the nozzle.
Figure 3B:
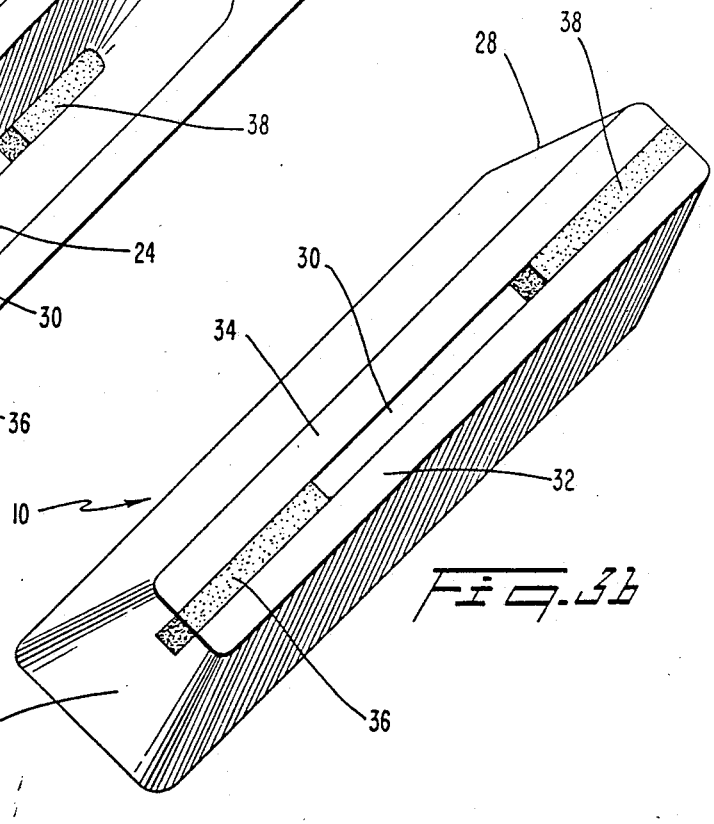
FIG. 3*b* is a perspective view showing the outlet side of the nozzle of FIG. 3*a*.
Figure 4:
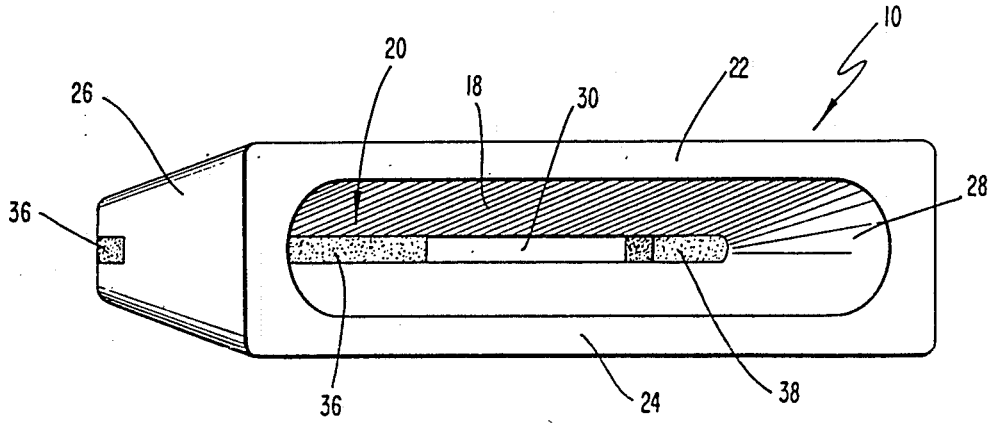
FIG. 4 is a perspective view showing the nozzle of FIGS. 1–3 with refractory cement inserts in the longitudinal dispensing slots defining a nonsymetrical outlet.

As is apparent from the illustrations of FIGS. 2–4, the nozzle 10 has a generally rectangular configuration with a relatively wide inlet opening 18 for receiving molten metal. The opening 18 leads to an internally disposed V-shaped cavity for the melt and defined by converging side walls 22,24 and end walls 26, 28. The side and end walls terminate in an elongated discharge slot 30 (FIG. 2*a*) opposite the inlet 18.

The discharge slot 30 is defined by a pair of elongated lips 32 and 34 extending from side walls 22 and 24 respectively. The lips 32,34 are disposed in closely spaced relationship to the casting surface 14 (FIG. 1) and direct the flow of molten metal discharged from the nozzle 10.

Referring specifically now to FIGS. 3*a* and 3*b*, it may be seen that the discharge slot 30, unlike the discharge slots of the prior art, extends transversely across the entire nozzle length. The discharge slot 30 is formed as a straight machined rectangular groove on the external bottom (in the orientation of FIG. 1) of the nozzle 10 continuously extending between and through end walls 26 and 28. FIG. 3*b* shows inserts 36 and 38 filled into opposite longitudinal ends of the discharge slot 30. These inserts 36 and 38 reduce the length of the discharge flow path from the nozzle 10 and thus define the width of any ribbon cast from the nozzle. The insert material 36,38 is selected to be compatible to the nozzle material with similar thermal expansion/contraction rates to avoid thermally induced cracking. If the nozzle 10 is formed of ceramic material, for example, any number of commercially available castable ceramic cements could be used for the insert material 36,38. Similarly, if the nozzle 10 is aluminum based ceramic, an aluminum based cement would preferably be used, such as x-9 cement from Laber Corporation.

Externally machining a continuous external groove on the nozzle 10 as a discharge slot 30 and subsequently filling in the longitudinal ends of the slot 30 offers substantial advantages and cost savings over prior art nozzles. Conventional rotating milling tool 35 (FIG. 2*a*) with the nozzle moving relative to the tool (see arrow) and a thickness equal to the width of the slot may be used to machine the groove. Furthermore, a single machining operation can be used to produce nozzles for casting different widths of ribbon 12. The ribbon width may be decided after the machining operation by filling in the desired end lengths of the discharge slot 30 to determine the discharged ribbon width. Moreover, the forming operations of conventional casting nozzle slots frequently result in high stress areas at the longitudinal ends of the slots. Cracks commonly originate in these high stress areas and propagate throughout the nozzle. Machining completely across the nozzle relieves the stress concentration and increases nozzle life. Cement fillers are frequently more resilient than the nozzle material and less susceptible to stress cracking. Furthermore, in the event cracks do originate in the insert material, they are not communicated to the nozzle.

As further depicted in FIG. 4, the invention also readily accommodates a nonsymmetrical fill-in with inserts 36,38 of differing lengths at opposite longitudinal ends of the groove. A nozzle with nonsymmetrical inserts 36,38 can be highly advantageous in interfacing with a casting substrate. Additionally, the insert material may be used to divide a discharge slot into multiple flow paths to cast two or more products simultaneously from the same nozzle 10.

In summary, numerous benefits have been described which result from employing the concepts of the invention. The invention facilitates the economical manufacture of the nozzle, alleviating the need for special tools. The machining process in forming the nozzle body is independent of the desired cast ribbon width, permitting a machined nozzle to be used for a wide range of ribbon widths. The invention further readily allows nonsymmetrical discharge from the nozzle, facilitating alignment between the nozzle and a casting surface. Moreover, the invention relieves stress concentrations at the longitudinal ends of the discharge slots. The insert material is less likely to develop stress cracks and further serves to confine any cracks which might develop in the insert area.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill int he art to best utilize in the invention in various embodiments and with various modifications as are suited to the particular use contemplated. It is intended that the scope of the invention be defined by the claim 3 appended hereto.

I claim:

1. A nozzle for controllably casting a continuous metal strip, comprising:

(a) a nozzle body, said nozzle body having an inlet for receiving molten metal from a reservoir;

(b) a continuous, elongated slot extending transversely across substantially the entire length of the nozzle body in fluid communication with said inlet defining a discharge path for molten metal received by said nozzle body, said slot separating a pair of spaced cooperating lips for directing molten metal onto a casting surface; and (c) castable refractory inset material, compatible with said nozzle, cast in place in a portion of said slot between the lips so as to be securely held in position for limiting the transverse dimension of the discharge slot and minimizing cracking.

2. A nozzle as recited in claim 1 wherein the insert material is disposed in both end portion of the elongated slot to define the discharge path centrally disposed between the insert material.

3. A nozzle as recited in claim 2 wherein the elongated slot is an external groove.

4. A nozzle as recited in claim 3 wherein the nozzle is formed of a ceramic material.

* * * * *